United States Patent [19]

Toda et al.

[11] Patent Number: 4,754,246

[45] Date of Patent: Jun. 28, 1988

[54] CIRCUIT INTERRUPTER

[75] Inventors: Haruhisa Toda; Kazuhiro Ishii; Toshiyuki Tanibe; Hiroaki Fugihisa, all of Fukuyama, Japan

[73] Assignee: Mitsubishi Denki Kabushiki Kaisha, Japan

[21] Appl. No.: 80,108

[22] Filed: Jul. 31, 1987

[30] Foreign Application Priority Data

Aug. 7, 1986 [JP] Japan ..... 61-187265

[51] Int. Cl.[4] ..... H01H 75/00; H01H 77/00

[52] U.S. Cl. ..... 335/21; 335/6; 335/172; 337/70

[58] Field of Search ..... 335/6, 8–10, 335/21, 172, 173, 174, 175, 176; 337/70, 74

[56] References Cited

U.S. PATENT DOCUMENTS 3,775,713 11/1973 Walker et al. ..... 335/176
4,037,184 7/1977 Kempisty, Jr. et al. ..... 335/6
4,064,469 12/1977 Gryctko ..... 335/132

*Primary Examiner*—H. Broome
*Attorney, Agent, or Firm*—Leydig, Voit & Mayer

[57] ABSTRACT

A circuit interrupter comprising an automatic trip unit connected to an interrupting unit for tripping the interrupting unit to open separable contacts in response to an overcurrent, the automatic trip unit being a replaceable unit selected from a plurality of differing types of trip units including an electronic trip unit and a thermally responsive electromagnetic trip unit.

3 Claims, 8 Drawing Sheets

CIRCUIT INTERRUPTER

BACKGROUND OF THE INVENTION

This invention relates to a circuit interrupter and more particularly to a circuit interrupter provided with an automatic trip mechanism.

A conventional circuit interrupter to which the present invention pertains will be described in conjunction with FIGS. 1 to 5. FIG. 1 is a sectional side view of the conventional circuit interrupter, FIG. 2 is a partial enlarged sectional view of FIG. 1 and showing the ON position, FIG. 3 is a view similar to FIG. 2, but illustrating the OFF position, FIG. 4 is a view similar to FIG. 2, but illustrating the TRIP position, and FIG. 5 is a view similar to FIG. 2, but illustrating the electromagnetically operated position.

In these figures, the circuit interrupter comprises an electrically insulating housing 1 having a base 1*a* and a cover 1*b*. A stationary source side conductor 2 is mounted on the base 1*a* and has a stationary contact 3 secured thereon. Mounted in the housing 1 is an automatic trip unit 4 of a thermally responsive type, an electromagnetic type or an electronic type. A stationary load side conductor 5 is electrically connected to the automatic trip unit 4. A movable contact 6 is secured to a movable member 7 which is electrically connected to the automatic trip unit 4 through a flexible conductor 8 and a connector 9. The movable member 7 is supported by a contact arm assembly 10 comprising a first contact arm 10*a* connected to an operating mechanism 20 which will be described in more detail later, and a second contact arm 10*b* on which the movable member 7 is pivotally supported by a first pin 11. The first contact arm 10*a* and the second contact arm 10*b* are independently pivotally supported within the housing by a pivot pin 12. The first contact arm 10*a* has formed therein a first elongated guide hole 14 extending substantially in a direction of movement thereof. The second contact arm 10*b* has formed therein a second elongated guide hole 15 extending in a direction of extension thereof. A sliding pin 16 extends through the first and second guide holes 14 and 15 to limit the relative pivotal movement between the first and second contact arms 10*a* and 10*b*. The sliding pin 16 is biased toward a free end of the second contact arm 10*b* by a tension spring mounted between the sliding pin 16 and the first pin 11 pivotally connecting the movable member 7 to the second contact arm 10*b*. In order to provide a contact biasing force between the movable and the stationary contacts 6 and 3, a contact pressure spring 18 is disposed between the movable member 7 and the second contact arm 10*b*. An operating handle 19 is connected to the operating mechanism comprising a releasable cradle 20*a* having a stop pin 21 and a pair of toggle links 20*b* and 20*c* connected between the cradle 20*a* and the first contact arm 10*a* by pivot pins 22*a* and 22*b*. As is well known, an arc extinguisher 23 is disposed in such a way as to extinguish the arc generated between the separated contacts when they separate.

When the circuit interrupter is in the ON position shown in FIGS. 1 and 2, an electric current flows from the source side stationary conductor 2 to the load side stationary conductor 5 through the stationary contact 3, the movable contact 6, the movable member 7, the flexible conductor 8, the connector 9 and the automatic trip unit 4 in the named order. When the operating handle 19 is moved into the OFF position as shown by an arrow 24 of FIG. 2, the contact arm assembly 10 is lifted by the operating mechanism 20 so that the movable contact 6 together with the movable member 7 is moved away from the stationary contact 3 as shown in FIG. 3 to separate the contacts 3 and 6. At this time, since the sliding pin 16 is positioned in a recessed portion 14*a* of the guide hole 14 due to the biasing function of the tension spring 17, the second contact arm 10*b* is rotated about the pivot pin 12 into the opening direction by the operating mechanism 20 together with the first contact arm 10*a* until it abuts against the stop pin 21.

In the ON position shown in FIGS. 1 and 2, when an overload current flows through the circuit interrupter, the automatic trip unit 4 is actuated to release the cradle 20*a* of the operating mechanism 20 to allow it to rotate in a direction of the arrow 24 of FIG. 2. Then, the toggle links 20*b* and 20*c* of the operating mechanism 20 rotate the contact arm assembly 10 in a clockwise direction to separate the movable contact 6 from the stationary contact 3, thereby interrupting the overload current. This is the so-called tripped position. During this operation, since the sliding pin 16 is positioned within the recessed portion 14*a* of the guide hole 14 due to the tension spring 17 similarly to the OFF position shown in FIG. 3, the second contact arm 10*b* is rotated clockwise about the pivot pin 12 by the operating mechanism 20 together with the first contact arm 10*a* until it abuts against the stop pin 21.

When a large current such as a short-circuit current flows through the circuit interrupter in the ON position shown in FIGS. 1 and 2, an electromagnetic repulsive force generated between the stationary conductor 2 and the movable member 7 causes the movable member 7 to be immediately separated from the stationary conductor 2 as shown in FIG. 5. At this time, since the operating mechanism 20 does not allow the first contact arm 10*a* to be actuated because it has not yet been actuated, the second contact arm 10*b* rotates clockwise as shown by an arrow 26 in FIG. 2 about the pin 12 by moving the sliding pin 16 against the spring force of the tension spring 17 from the recessed portion 14*a* along the guide hole 14 until it abuts against an end portion 14*b* of the guide hole 14. An electromagnetic repulsive force generates very quickly upon the occurence of a short-circuit current and therefore the contact separation is achieved before the operating mechanism 4 is actuated, providing a high current limiting capability.

Immediately after the electromagnetic repulsive separation is achieved, the automatic trip unit 4 trips and rotates the first contact arm 10*a* to return the sliding pin 16 into the recessed portion 14*a* of the guide hole 14 to take up the tripped position shown in FIG. 4.

With the conventional circuit interrupter as above described, since the circuit interrupter is provided with the automatic trip unit 4 assembled within the interrupter housing, the circuit interrupter must be manufactured separately for each of the types of automatic trip unit, such as an electronic trip unit or a thermally responsive electromagnetic trip unit.

SUMMARY OF THE INVENTION

Accordingly, an object of the present invention is to provide a circuit interrupter in which an automatic trip unit such as an electronic trip unit or a thermally responsive electromagnetic trip unit mounted in the housing can be easily replaced with other types of automatic trip units.

Another object of the present invention is to provide a circuit interrupter which can be interchangeably used with various types of automatic trip units.

A further object of the present invention is to provide a circuit interrupter which need not be manufactured separately according to the type of automatic trip unit, such as an electronic trip unit and a thermally responsive electromagnetic trip unit.

With the above objects in view, the circuit interrupter of the present invention comprises an interrupting unit and an automatic trip unit for tripping the interrupting unit, the automatic trip unit being a replaceable unit selected from a plurality of differing trip units including electronic trip units and thermally responsive electromagnetic trip unit, and operatively connectable to the interrupting unit.

BRIEF DESCRIPTION OF THE DRAWINGS

The present invention will now be described in terms of the preferred embodiment of the present invention taken in conjunction with the accompanying drawings, in which.

DETAILED DESCRIPTION OF THE PREFERRED EMBODIMENTS

Figure 1:
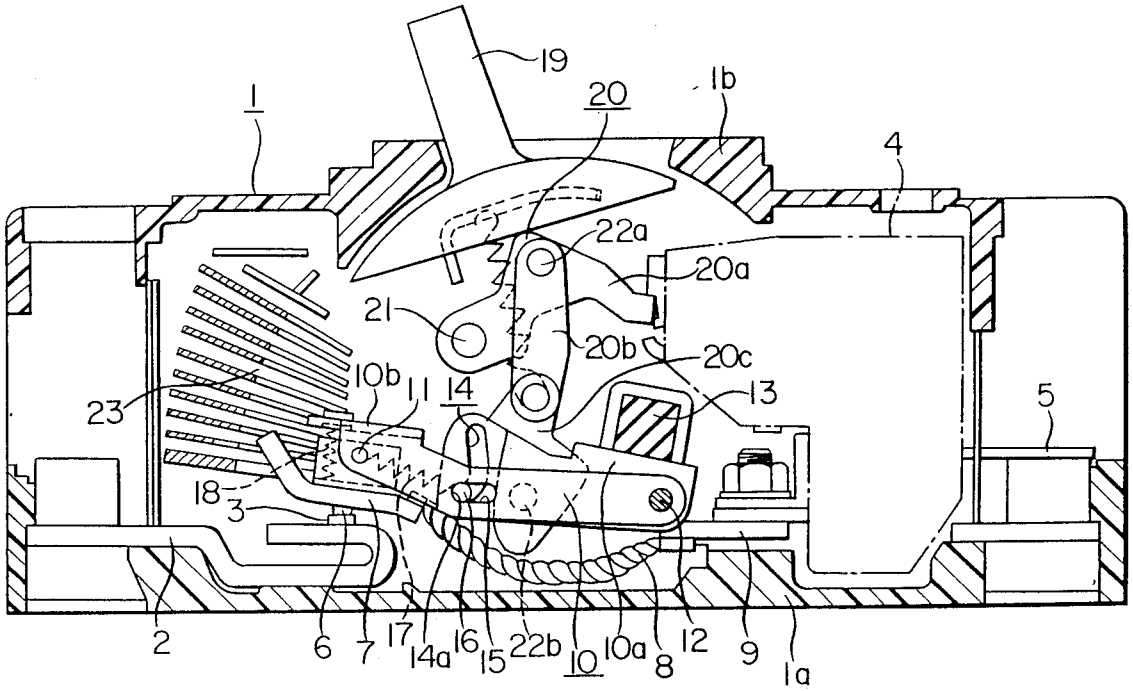
FIG. 1 PRIOR ART
FIG. 1 is a sectional side view of the conventional circuit interrupter.
Figure 2:
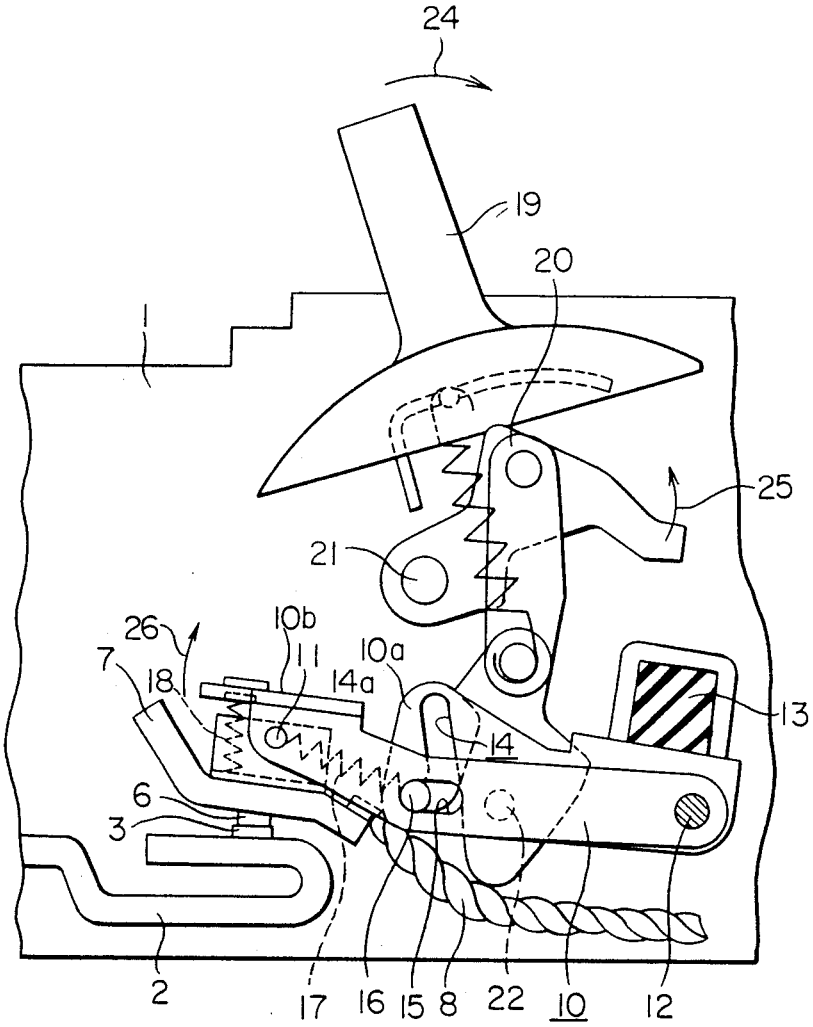
FIG. 2 PRIOR ART
FIG. 2 is a partial enlarged sectional view of FIG. 1 and showing the ON position.
Figure 3:
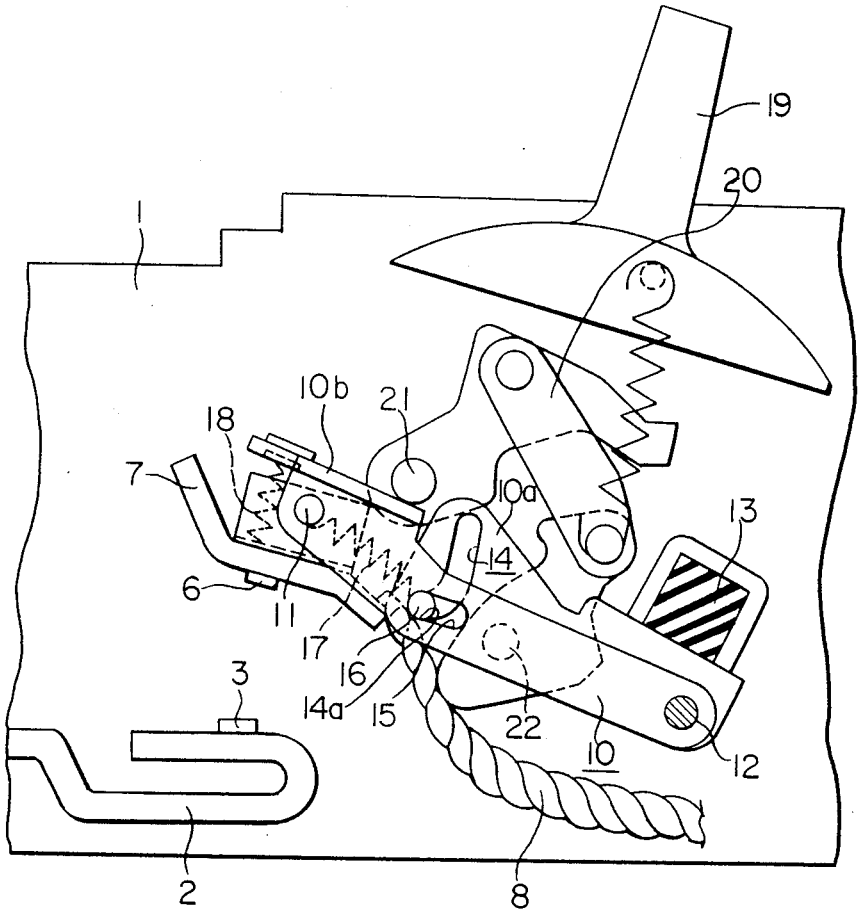
FIG. 3 PRIOR ART
FIG. 3 is a view similar to FIG. 2, but illustrating the OFF position.
Figure 4:
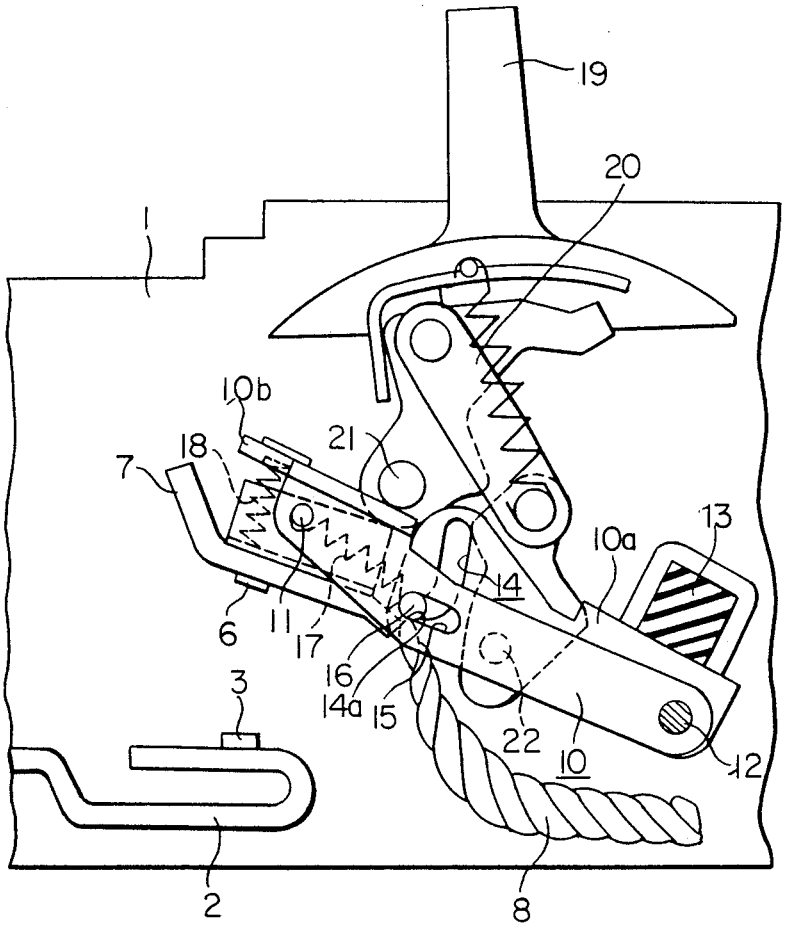
FIG. 4 PRIOR ART
FIG. 4 is a view similar to FIG. 2, but illustrating the TRIP position.
Figure 5:
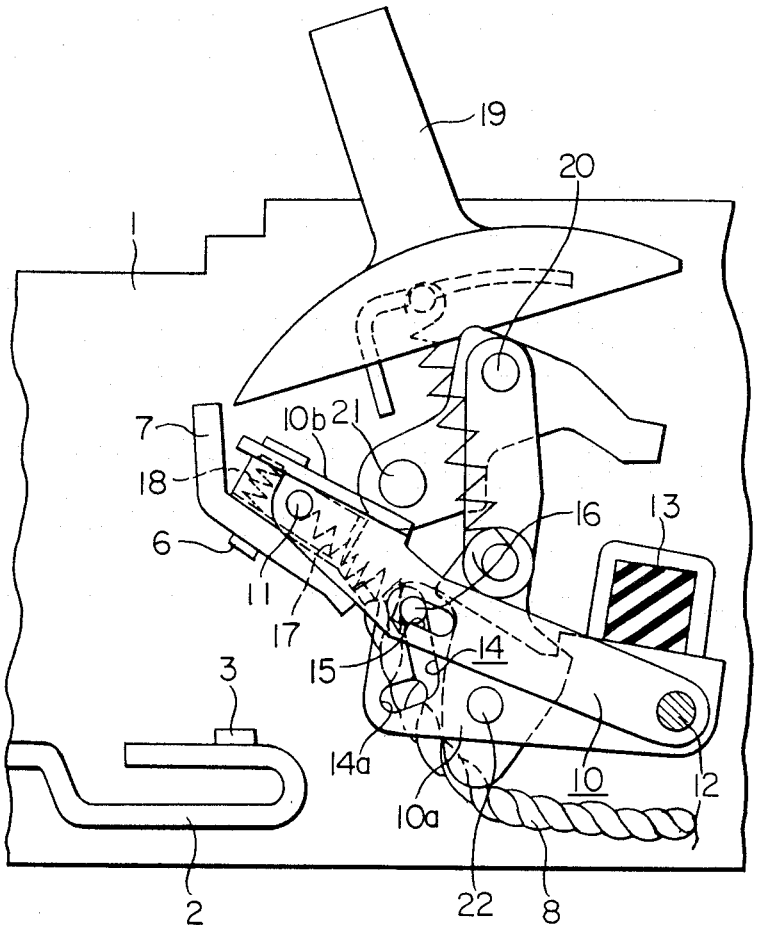
FIG. 5 PRIOR ART
FIG. 5 is a view similar to FIG. 2, but illustrating the electromagnetically operated position.
Figure 6:
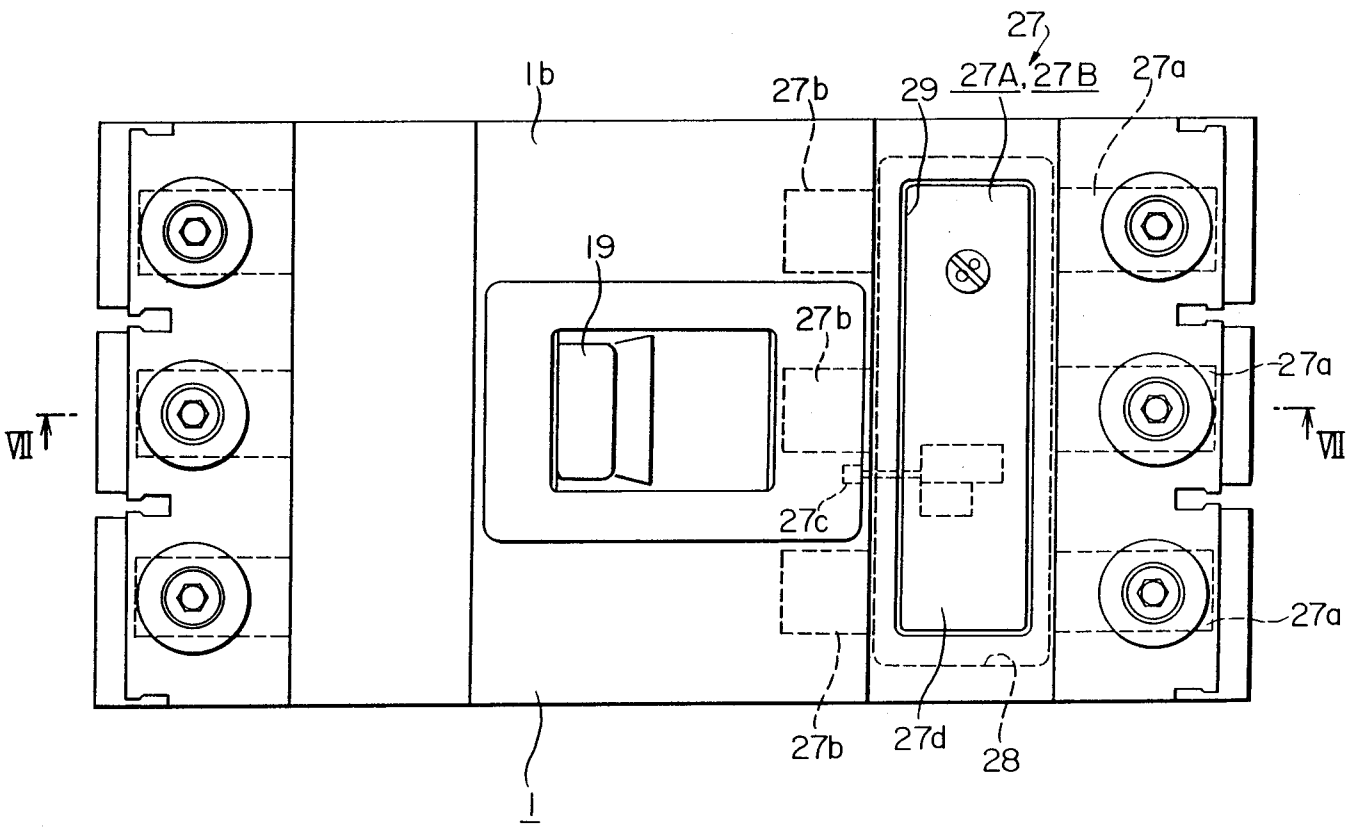
FIG. 6 is a plan view of a circuit interrupter of the present invention.
Figure 7:
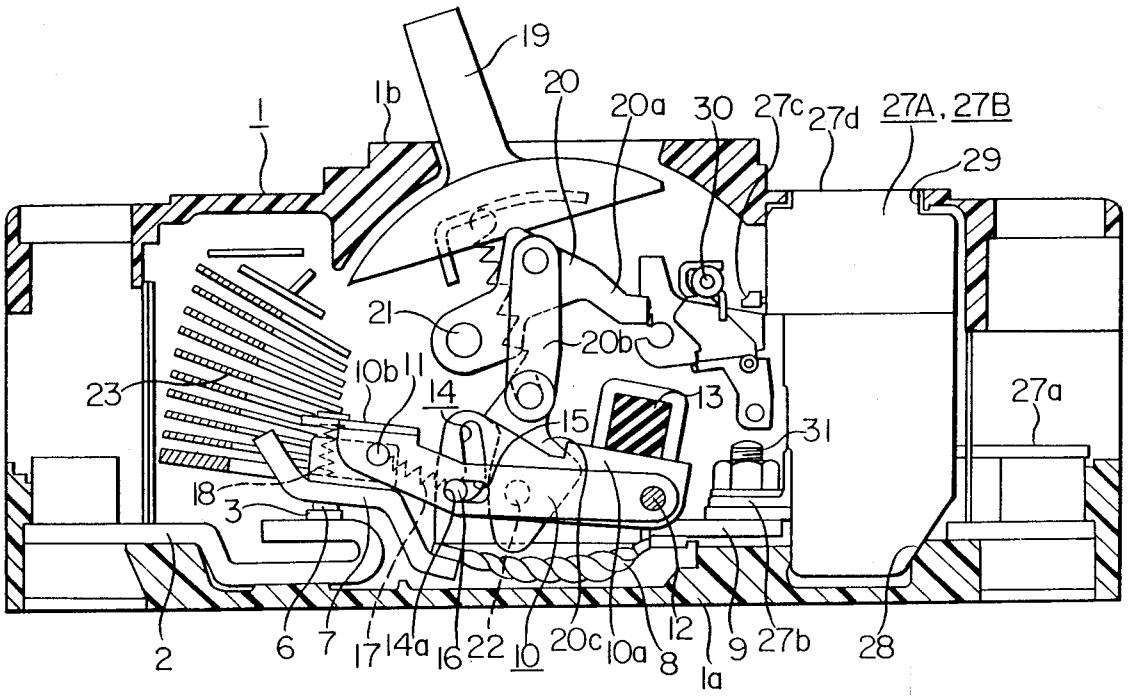
FIG. 7 is a sectional side view of the circuit interrupter of the present invention taken along line VII—VII of FIG. 6.
Figure 8:
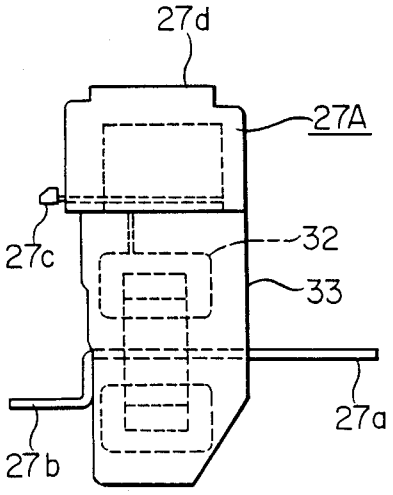
FIG. 8 is a side view of an electronic type automatic trip unit.
Figure 9:
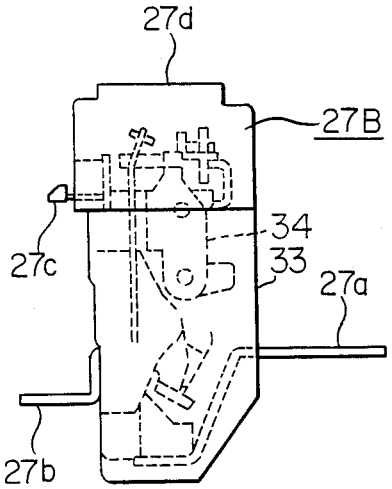
FIG. 9 is a side view of a thermally responsive electromagnetic, automatic trip unit.

An embodiment of the present invention will now be described in conjunction with FIGS. 6 to 9. FIG. 6 is a plan view of a circuit interrupter of the present invention, FIG. 7 is a sectional side view of the circuit interrupter of the present invention taken along line VII—VII of FIG. 6, FIG. 8 is a side view of an electronic type automatic trip unit, and FIG. 9 is a side view of a thermally responsive electromagnetic, trip unit. The same reference numerals in the figures designate identical or corresponding components.

In these figures, an automatic trip unit 27 for tripping a multi-pole interrupter as shown in FIGS. 6 and 7 is a replaceable unit selected from a plurality of differing types including electronic and thermally responsive electromagnetic trip units and operatively connectable to the interrupting unit. FIG. 8 shows one example of an electronic trip unit 27A which comprises an electronic trip mechanism 32, and a housing 33 for housing the electronic trip mechanism 32, and FIG. 9 shows one example of a thermally responsive electromagnetic trip unit 27B which comprises a thermally responsive electromagnetic trip mechanism 34 housed in the housing 33. It is to be noted that the outer configuration of the housing 33 of the unit 27A is identical to that of the unit 27B.

The electronic trip unit 27A includes, for each pole unit, a terminal conductor **27*a*, and a shunt connection conductor 27*b* projected from the housing 33. In the assembled state, the terminal conductors 27*a* of a plurality of pole units extend toward and are connected to load side terminals of the circuit interrupter. The shunt connection conductors 27*b* are connected to the connecting conductors 9 by fasteners such as nuts and stud bolts 31 (FIG. 7). The electronic tirp unit 27A also has a single trip rod 27*c* projecting from the housing 33 for activating the operating mechanism 20 for a central pole through a latch mechanism 30 which will be described in more detail later. Thus, when the electronic trip unit 27A is installed in the interrupting unit of the circuit interrupter as shown in FIG. 7, it is connected between the load side terminal and the connecting conductor 9 so that the current flowing through the circuit interrupter flows through the electronic trip unit 27A, and the trip rod 27*c* is in a position capable of acting on the latch mechanism 30. The housing 33 has a land portion 27*d* which may serve as a display for displaying the kind of automatic trip unit used. Thus, the outer configuration of trip units 27A and 27B including the conductors 27*a* and 27*b* and the trip rod 27*c* are identical to each other, so that the trip units 27A and 27B** are interchangeable with respect to the interrupting unit of the circuit interrupter.

The housing 1 of the circuit interrupter is so configured as to accommodate the automatic trip unit 27A or 27B therein. The base **1*a* of the housing 1 has a recessed portion 28 in which the bottom portion of the trip unit 27A or 27B is received, and the cover 1*b* of the housing 1 has a window 29 into which the land portion 27*d* of the trip unit 27A or 27B is inserted so that the land portion 27*d*** is exposed to the exterior.

When an overcurrent flows through the circuit interrupter, the current flowing through the conductors **27*a* and 27*b* actuates the electronic trip mechanism 32 of the electronic trip unit 27A or the thermally responsive electromagnetic trip unit 27B to push forward the trip rod 27*c*, which then actuates the latch mechanism 30 on the interrupting unit of the interrupter to release the latching engagement between the latch mechanism 30 and the cradle 20*a* of the operating mechanism to open separate the contacts 3 and 6** in a manner known in the art.

While the automatic trip unit 27A or 27B are illustrated in the above embodiments as having a width extending over three pole units of the three-pole circuit interrupter, the width dimension of the trip unit 27A or 27B may be determined independent of the number of the pole units of the circuit interrupter.

As has been described, the automatic trip unit of the circuit interrupter of the present invention is a replaceable unit selected from a plurality of differing types of trip units including electronic trip units and thermally responsive electromagnetic trip units, and the trip unit can be operatively connected to the interrupting unit of the circuit interrupter. Therefore, automatic trip units such as electronic trip units or thermally responsive electromagnetic trip units mounted in the housing can be easily replaced with other types of automatic trip units. Further, the circuit interrupter need not be manufactured separately according to the type of automatic trip unit.

What is claimed is:

1. A circuit interrupter comprising a replaceable automatic trip unit connected to an interrupting unit for tripping said interrupting unit to open separable contacts in response to an overcurrent, said replaceable automatic trip unit being selected from a plurality of differing types of trip units including an electronic trip unit and a thermally responsive electromagnetic trip unit, and having a unit housing, an automatic trip mechanism disposed in said unit housing, a terminal conductor element, a shunt connector conductor element, and a trip rod element, the latter three elements projecting from said unit housing.

2. A circuit interrupter as claimed in claim 1 further comprising a housing for housing therein said interrupting unit and said automatic trip unit, said housing having a cavity for receiving said automatic trip unit therein.

3. A circuit interrupter as claimed in claim 2 wherein said housing comprises a base having formed therein a recessed portion in which a bottom portion of said automatic trip unit is received, and a cover having a window through which a part of said automatic trip unit extends and is exposed to an exterior for displaying the type of said automatic trip unit used in the circuit interrupter.

* * * * *